US005557311A

United States Patent [19]

Perrington et al.

[11] Patent Number: 5,557,311

[45] Date of Patent: Sep. 17, 1996

[54] MULTI-PAGE SIGNATURES MADE USING LASER PERFORATED BOND PAPERS

[75] Inventors: Kenneth J. Perrington, Maplewood; Thomas H. Hunter, Woodbury; Keith P. Wilson, St. Paul, all of Minn.

[73] Assignee: Minnesota Mining and Manufacturing Company, St. Paul, Minn.

[21] Appl. No.: 76,464

[22] Filed: Jun. 11, 1993

[51] Int. Cl.[6] ..... G03G 21/00; B42D 15/00

[52] U.S. Cl. ..... 347/111; 283/103; 283/63.1; 355/310; 346/141; 358/304

[58] Field of Search ..... 358/304, 297; 347/111; 283/103, 63.1; 355/310; 346/141

[56] References Cited

U.S. PATENT DOCUMENTS

| | | | |
|---|---|---|---|
| 3,226,527 | 12/1965 | Harding | 219/364 |
| 3,790,744 | 2/1974 | Bowen | 219/121 LM |
| 3,909,582 | 9/1975 | Bowen | 219/121 LM |
| 4,041,193 | 8/1977 | Hayashi et al. | 427/151 |
| 4,231,273 | 11/1980 | Walter | 83/510 |
| 4,265,254 | 5/1981 | Koch et al. | 131/281 |
| 4,297,559 | 10/1981 | Whitman, III | 219/121 LB |
| 4,446,187 | 5/1984 | Eklund | 428/136 |
| 4,449,361 | 5/1984 | Hahnel | 60/254 |
| 4,449,362 | 5/1984 | Frankenberg et al. | 60/274 |
| 4,569,359 | 2/1986 | Nowers et al. | 131/281 |
| 4,808,566 | 2/1989 | Takashima et al. | 503/217 |
| 4,900,001 | 3/1990 | Lapeyre | 270/1.1 |
| 4,906,605 | 3/1990 | Kraft | 503/215 |
| 4,974,822 | 12/1990 | Richter | 270/48 |
| 4,996,184 | 2/1991 | Bevan et al. | 503/226 |
| 5,045,045 | 9/1991 | Davenport et al. | 493/363 |

FOREIGN PATENT DOCUMENTS

| | | |
|---|---|---|
| 0008161A1 | 2/1980 | European Pat. Off. . |
| 0536685A1 | 10/1992 | European Pat. Off. . |
| 4023997A1 | 1/1992 | Germany . |
| 59-095569 | 11/1982 | Japan . |
| 968824 | 9/1964 | United Kingdom . |
| 1442002 | 3/1974 | United Kingdom . |
| 2062576 | 11/1980 | United Kingdom . |

OTHER PUBLICATIONS

W. E. Lawson, "Application of Laser Technology to the Process of Nonwovens and Composites". Presentation at Impact 86 International Conference, Florida, Mar. 20–21, 1986, pp. 1–11.

W. E. Larson, "Laser Processing of Thin Materials". Presentation at Emerging Textile Technologies Conference, Greenfield, S. C., Dec. 8–9, 1987.

Dipl.–Ing. J. Mommsen et al., "Laser–Cutting and Perforating of Filter Paper", *Papier+Kunststoff Verarbeiter,* Aug. 1990, pp. 10–14.

B. Pineaux, *"The Effect of Laser Beam Cuts on the Strength of Paper Edges"*, Thesis–Rochester Institute of Technology, Feb. 1988.

N. Hattori et al., "Microscopic Observations of the Solid Products Deposited on the Edge of Papers by CO2 Laser Cutting", *Mokuzai Gakkaishi,* vol. 34, No. 5, pp. 417–422 (1988).

B. Pineaux, *"La Decoupe du Papier Au Rayon Laser"*, Review IG No. 375:43–47 (May 1989).

P. Ratoff et al., "Laser in the Paper Mill: Cutting, Perforating, or Scoring", *Chem.* 26, 1973, 9, 50.

"Carbonless Consolidates", British Printer, Feb. 1991, pp. 1–2.

Srinivasan et al., *Polymer* (1985), vol. 26, pp. 1297–1299.

Hattori, N., Sugihara, H., and Nagano, Y., *Journal of the Society of Materials Science,* Japan, Zairyo, vol. 28, No. 310; Jul. 1979; pp. 603–609.

Abstract, Paper chem. No. 44–02522 of *Papiers, Cartons, Complexes*, "Future of the Laser in Cutting of Paper", Oxtober 1972, pp. 51–52.

Mommsen, J. et a., "Laser–cutting and Perforating of Filter Paper", *Papier+Kunststoff Verarbeiter,* Sep. 1980, pp. 10–14 (translation).

Duley, W. W., "$CO_2$ Lasers–Effects and Applications", *Academic Press,* 1969 pp. 267–268.

Abstract, INSPEC No. A89120167, B89062793 of H. Kitani et al., "$CO_2$ Laser Applications", Mitubishi Denki Giho, vol. 63, No. 4, pp. 281–286 (1989).

Miller, C. H. et al., "Status Report on 250 Watt $CO_2$ Laser For Applications in the Pulp and Paper Industry", Presentation at the Fifteenth Annual IEEE Pulp & Paper Conference, Atlanta, Georgia, May 7–10, 1969. pp. 1–14.

P. Ratoff, "Laser Applications in the Paper Industry", *Pulp & Paper*, 1973, pp. 128–130.

W. E. Lawson, "Laser Technology: Applications for nonwovens and Composites", *Nonwovens World,* 1986, pp. 1, 89–92.

H. Honicke et al., "Cutting Paper with Electronic and Laser Beams", *The Paper Maker*, 1969, pp. 46, 48, 49.

*COPYmagazine*, Jul. 1990, vol. 10, No. 7., pp. 10 & 12.

*Primary Examiner*—Valerie A. Lund
*Attorney, Agent, or Firm*—Gary L. Griswold; Walter N. Kirn; Gregory A. Evearitt

[57] ABSTRACT

Brochures, pamphlets, books, and the like containing a plurality of laser-perforated paper which has been folded and bound (in either order) on the lines of perforation have, among other things, substantially improved compressed, lay-flat properties (i.e., significantly reduced bowing) as compared to conventional perforated paper containing books, pamphlets, and the like. Additionally, the inventive articles have surprisingly high strength on the lines of perforation and low paper slippage as well. The inventive processes provide for an easy and efficient way to produce brochures, pamphlets, signatures, and other paper-based products which are easy to handle, store, and transport.

23 Claims, No Drawings

MULTI-PAGE SIGNATURES MADE USING LASER PERFORATED BOND PAPERS

BACKGROUND OF THE INVENTION

1. Field of Invention

This invention relates to the manufacture of booklets and signatures. Booklets and signatures prepared from papers perforated using laser radiation are easily prepared and lie flatter than similarly prepared booklets and signatures prepared using unperforated or mechanically perforated papers.

2. Description of Related Art

It is traditionally taught in the printing and paper binding industry not to print or run perforated bond paper on printing presses or electrophotographic photocopiers, copier/duplicators and printers (such as, for example, "laser printers"). Additionally, it is taught in the printing and paper binding industry not to fold and bind sheets of paper into signatures along a line of perforation. All three of these processes are thought to result in tearing-apart, breaking, or otherwise separating the paper along the line of perforation.

It is also expected that binding a plurality of sheets of paper on their lines of perforation would result in a product with a considerable amount of slipping of the paper along the line of fold. This would be caused by staples, for example, sliding within a perforation.

For all of the above reasons, perforated paper is not used in the manufacture of booklets or signatures unless they are designed to be separated into individual sheets.

Current methods of paper perforation involve mechanical means. However, these methods have not been completely satisfactory. Mechanical perforation of paper scores and weakens the paper along the line of perforation, thus leading to a weakened perforation area which may prematurely separate. Another problem encountered with mechanical perforation results from the presence of a burr left on the paper. As a result of this burr, a stack of perforated paper is thicker in the perforated region due to the burred areas, and thus the stack does not lie flat. Attempts to remove these burrs adds another expensive processing step to the paper manufacture. Another disadvantage of mechanical perforation includes the accumulation of lint and paper dust around the perforated holes. The lint and dust cling to the paper and must be removed.

There are several methods of perforating paper sheets. Sheets can be perforated "off-line" after the printing operation using, for example, a perforating wheel or die, spikes, or an electrostatic discharge. Machines for carrying out these operations are commercially available as for example from Rollem Corp (Hempstead, N.Y.). Perforation can be caried out in a similar manner in a post-imaging staion attached to the imaging machine.

Perforation can be carded out during the printing process as, for example, on a lithographic press either before or after printing by using a material known as perforating tape, a narrow piece of metal with upraised spikes, which is attached to the impression roll of the press. Feeding of the paper through the press thus results in impingement of the perforating tape on the paper. However, because of the construction of the lithographic press, the rotation of the impression cylinder also results in impingement of the perforating tape on the blanket cylinder, resulting in perforation and consequent destruction of the blanket. A printer must therefore allow for the cost of replacement of the blanket when figuring the cost of the job. This two-step operation requires additional time and expense on the part of the printer.

If paper is perforated by any of the above methods prior to printing, the burr of paper detritus on the paper thickens the paper stack in the region of perforation. The resulting stack does not lie flat and subsequent attempts to stack such perforated paper in a printing press or a photocopier, copier/duplicator, or printer often results in jamming of the paper feed apparatus resulting in ruined sheets. Feeding of the perforated edge of the paper during the feed step of the printing, photocopying, or duplicating can also result in premature tearing of the paper along the perforation. The press thus needs to be closely monitored to prevent jamming and overflow in the receiving tray.

For the above mentioned reasons it is difficult to prepare paper having perforations that is suitable for feeding through sheet-fed equipment. It would be desirable to have a method of perforating paper which would provide sheets which lay flat, can be easily packaged, boxed and shipped, are easy to print, and which can be made into booklets and signatures.

There are reports describing the use of lasers to perforate paper. Paper has been perforated by burning the paper in the desired locations with a laser, in particular with a carbon dioxide laser. For example, an article entitled "Laser in the Paper Mill: Cutting, Perforating, or Scoring," (See P. Ratoff; J. E. Dennis; *"Chem* 26" 1973, 9, 50) describes the use of $CO_2$ lasers to convert paper. Ratoff also points out some advantages in the use of lasers to cut and perforate paper (see P. Ratoff *Pulp & Paper* 1973, 47, 128). Uniformity, consistency of hole sizes, and no need for removal of residual paper waste are some of the advantages mentioned. Tradeoffs such as charring of the edges of the perforation are noted. A more recent article entitled "Laser Technology: Applications for Nonwovens and Composites" (W. E. Lawson; *Nonwovens World* 1986, 1, 88) points out the advantages of using lasers to convert paper and mentions that smoke, debris, and burrs are considerations that need to be evaluated. An older reference that describes the potential of lasers to convert paper is "Cutting paper with electronic and laser beams," (H. Honicke; J. Albrecht *The Paper Maker* 1969, 46, 48.

The use of lasers to perforate carbonless paper to provide improved carbonless form-sets is disclosed in copending U.S. patent application Ser. No. 7/768,429 filed Aug. 16, 1991, the disclosure of which is incorporated herein by reference.

The use of laser energy to score, form a line of weakness, or perforate multilayer laminates containing thermoplastics, thermosets, paper, or foil is taught by Bowen. See W. E. Bowen, U.S. Pat. No. 3,909,582 (1975) and U.S. Pat. No. 3,790,744 (1974). Paper is not mentioned in detail, but attention is devoted to adhesives and various plastic materials. Bowen notes that the material removed by the heating process depends on nature of both the substrate and the coatings, the residence time of the laser, and the characteristics of the material itself. Bubbles and ridges rather than scores or perforations may occur where these are not properly matched.

Hattori et al. report the use of a carbon dioxide laser to cut Kraft paper and filter paper. They observed a pyrolysis-like residue adhered on both cut edges as solid droplets, and the color and quantity of the droplets varied largely with the condition of laser irradiation (N. Hattori; H. Sugihara; Y. Nagano *Zairyo* 1979, 28, 603; *Chem. Abstr.* 80:5220).

The perforation of cigarette papers using lasers is known. However, cigarette paper is a very thin highly porous paper in order to control the composition of the smoke being inhaled. For example, Whitman teaches a system for precision perforation of moving webs employing a pulsed fixed focus laser beam wherein the laser pulses are automatically controlled in pulse repetition frequency and in pulse width to provide a desired porosity to the web of cigarette paper. See H. A. Whitman III, U.S. Pat. No. 4,297,559.

An apparatus for perforating sheet material using a laser is disclosed by W. H. Harding in U.S. Pat. No. 3,226,527 (1965).

Very often in the printing and copying industry, signatures and pamphlets are prepared by printing onto sheets that are two or more times the size of the intended final product. This reduces the number of sheets that must pass through the printing or copying process. For example, sheets may have the dimensions of 11 inches by 17 inches. After the sheet is printed, copied upon, or otherwise manipulated, the sheet is folded in half to provide 1-sheet having 2-leafs (4 sides or pages), each leaf having the dimensions of 11 inches by 8½ inches. This is known aa a 4-page "signature." Similarly, the sheet may have the overall dimensions of 22 inches by 17 inches. Folding and trimming provide two 17 inch by 11 inch sheets with a fold dividing each sheet into two 8½ inch by 11 inch sections or leafs. These sheets are then assembled into a booklet of 2-sheets having 4-leafs (8 sides) to provide an 8-page signature. Variations of sheet size and location of folds and trimming provide different sizes of paper booklets or increased numbers sheets from the single large sheet. A number of sheets are then collated into a set; the collated sets are folded; and the folded assembly is sealed, glued, stitched, or stapled into a completed or booklet. Such a completed booklet is known as a "signature." Signatures, are used, for example, in multi-page brochures or reports.

One problem encountered when preparing signatures in this manner, i.e., by folding and binding, is that the fold does not lie flat. Thus, one wishing to read a pamphlet or report (i.e., a "signature") of this type must refold the pages or the signature will have a tendency to close or turn pages by itself. One method of overcoming this problem is by scoring the area to be folded. Scoring removes some stiffnesss from the paper and allows the paper to be folded. Scoring may be carded out by mechanical means or by a method referred to as "water-scoring." Water-scoring swells the paper fibers, removing some stiffness from the paper, and allows the paper to be folded. Both mechanical and water-scoring result in a flatter signature with less "bow," a flatter profile, and a tighter finished fold. Upon opening, such a signature lies flatter and has minimal tendency to "page-turn." However, water-scoring requires special equipment.

There are several commercial methods of preparing signatures. In one, the paper is printed, then each sheet is separately folded to insure a tight fold. The sheets are then taken to a machine called a saddle-stitcher where the folded sheets are collated, the spine is stitched or stapled, and the signature is trimmed to finished size. This results in signature of excellent finished quality, but requires a long lead time, three production steps (printing, folding, saddle stitching), and expensive equipment.

In a more commonly used method, the paper is printed, and the printed sheets are taken to a machine called a "multi-binder" where the flat sheets are collated into sets, the spine is stitched or stapled together, and the signature is folded and trimmed to finished size. This results in a signature of marginal finished quality, but requires a short lead time and two production steps (printing and multi-binding).

In a third method, the paper is printed upon using an electrophotographic photocopier, copier/duplicator or printer fitted with an in-line machine that automatically collates into sets, staples or stitches, folds, and trims the sheets into a finished signature. This results in a signature of marginal finished quality, but requires no lead time anti only one production step (printing and binding are done on the same machine).

Most small commercial publishers, in-plant print shops, and quick-printers tend to use multi-binder techniques. Electrophotographic production of signatures is an evolving technology.

SUMMARY OF THE INVENTION

In accordance with the present invention it has now been discovered that brochures, pamphlets, books, signatures, and the like containing a plurality of laser-perforated paper which has been folded and bound (in either order) on the lines of perforation have, among other things, substantially improved compression, lay-flat properties (i.e., significantly reduced bowing), and storage and handling properties as compared to conventionally prepared paper containing books, pamphlets, and the like.

Thus, in one embodiment the present invention provides a process for producing a folded, bound, laser-perforated, paper-based construction, the process comprising the steps of:

(a) creating a line of perforations through a paper substrate by exposure to a laser beam;

(b) collating a plurality of the laser perforated paper substrates into sets;

(c) folding the sets on their lines of perforation; and (d) binding the folded sets on their lines of perforation into a signature.

In another embodiment, the present invention provides a process for producing a folded bound, laser-perforated, paper-based construction, the process comprising the steps of:

(a) creating a line of perforations through a paper substrate by exposure to a laser beam;

(b) collating a plurality of the laser perforated paper substrates into sets;

(c) binding the sets on their lines of perforation; and (d) folding the bound sets on their lines of perforation and into a signature.

In still another embodiment, the present invention provides a further process for producing folded, bound, laser-perforated, paper-based construction, the process comprising the steps of:

(a) creating a line of perforations through a paper substrate by exposure to a laser beam;

(b) generating a latent image on the a surface of an imaging element;

(c) developing the latent image with toner; and (d) transferring the developed image to the surface of a sheet of the laser perforated paper, (e) collating a plurality of the laser perforated substrates of step (d) into sets;

(f) folding the sets on their lines of perforation; and (g) binding the sets on their lines of perforation into a signature.

In still further embodiments, the present invention provides folded, bound, laser-perforated paper containing articles made by any of the foregoing disclosed inventive processes.

The articles of the present invention have significantly improved compression, lay-flat properties. Additionally, the inventive articles have surprisingly high strength on the lines of perforation and low paper slippage as well. The inventive processes provide for an easy and efficient way to produce brochures, pamphlets, signatures, and other paper-based products which are easy to handle, store, and transport. The invention allows the use of multi-binder technology with perforated paper printed on a printing press, photocopier, copier/duplicator, or printer to prepare high-quality signatures. In view of the traditional problems encountered in the printing and publishing industry in the utilization of perforated paper which were discussed earlier herein, the properties and advantages of the present invention were completely unexpected.

Other advantages, aspects, and benefits of the present invention are apparent from the detailed description, the examples, and the claims.

DETAILED DESCRIPTION OF THE INVENTION

The present invention uses a laser beam to perforate paper. The use of lasers to perforate paper results in a surprisingly rigid perforation. Paper perforated using laser beam perforation techniques surprisingly are much more capable of surviving stresses experienced in the routine handling of paper, particularly when paper is processed by machines such as sheet-fed printing presses, photocopiers, copier/duplicators, and printers, and folding equipment. Laser perforated paper also has the ability to lay flatter than mechanically perforated paper.

It would be expected that the heat generated by the laser would adversely react with the paper and create a residue on the paper surface. It might further be expected that the heat of the laser would char and discolor the regions of the paper adjacent to the perforation. However, it was discovered that laser perforation avoids the above problems and has many advantages over mechanically perforated paper.

Perforation of paper by a laser is accomplished by absorption of high intensity radiation by the paper fibers. During the laser pulse, the paper is decomposed with the formation of very little residue and dust. The laser process forms very clean perforations. In the context of this invention, a perforation is a hole that extends entirely through the paper.

Among the advantages to using laser radiation to perforate papers is their ability to be controlled. Laser radiation can be pulsed or chopped, thus radiation striking the paper can be turned on and off to form areas of "holes and lands." The "land" is the area between the holes that was not removed during perforation. In pulsed mode, the laser is turned on and off very rapidly; the duration of each pulse and the time between pulses (i.e., the repetition rate) being variable to control the ratio of the holes and lands and the space between each hole. In chopped mode, the laser beam is interrupted to vary the hole/land ratio and hole spacing. Interruption of the laser beam may be by mechanical means such as a rotating disc or mirror or by electronic means, as for example by an electronically operated shutter. By adjusting the time period in which the laser is incident in conjunction with the web speed of the paper, or by altering the configuration of the laser beam itself, the shape of the hole may itself be altered. Thus, the hole may be round or elongate in shape. In contrast to mechanical methods of perforation, with laser-perforation of paper there is no scoring or weakening of the paper in the land areas along the line of perforations.

The preferred laser for the present invention is a laser having high beam quality and good pulse characteristics. The combination of these properties in an axial flow laser results in well shaped perforation holes. Lasers in the 300 watt range often have these qualities and are well suited for the present invention. Suitable lasers are high speed pulsed lasers commercially available from Trumpf and Company, Gmbh, such as the Model TLF 1000 Turbo with modifications from Laser Machining Incorporated, Somerset, Wis.

The strength of the perforation is an important consideration in production of pamphlets, signatures, brochures, etc. If a perforation weakens during shipping and handling, there runs the risk of leaf separation of the signature. It is important that the signature remain structurally intact.

The strength of a perforated sheet of paper is related, in part, to the ratio of the areas of the "holes and lands," the thickness and moisture content of the paper, and the nature of the coatings. In general, the larger the hole/land ratio, the easier the paper is to tear. However, if there is too much hole area, then the paper may not have sufficient pull strength and pull apart during printing, collating, folding, and binding. By controlling the on/off time or the configuration of the laser, the ratio of the areas of the lands and holes can be adjusted until the perforations in the paper have the desired properties. It is suggested to have a hole/land area ratio in the range of about 1:10 to 6:1 and preferably in the range of about 1:6 to 4:1.

The present invention particularly advantageous for papers used in sheet fed presses, photocopiers, copier/duplicators and printers. Standard paper weights for use in commercial photocopiers, having a basis weight of 20 to 28 pounds, also particularly benefit from the present invention. By basis weight is meant "pounds/1300 sq. ft." The line of perforation according to the present invention does not subject the land areas to physical damage, thereby preserving the strength and integrity of the small amount of material remaining.

The strength of the perforation line as presently described is also advantageous in lightweight papers having a folio ream weight of 20 pounds or less because these papers have less bulk in their land areas to provide strength.

The advent of high speed electrophotography and photocopiers having dependable, high capacity, collating systems, has resulted in attempts to print perforated papers on these machines. The use of electrophotography to print onto perforated papers has met with limited success for a variety of reasons. One major problem encountered with printing onto perforated papers via high speed sheet-fed printing presses, photocopiers copier/duplicators and printers is separation of the paper along the line of perforation while undergoing printing. These attempts have invariably involved the use of mechanically perforated papers.

Mechanical perforation involves some type of blade, needle or spike cutting through the paper. As a result of this cutting action, mechanical perforation results in a pulling of paper fibers from the land areas, thus weakening the perforation. In contrast to mechanical methods of perforation, laser perforation is non-contact, does not involve stressing the land areas, and does not weaken the paper in the land areas along the line of perforation.

Also in contrast to the use of mechanically perforated papers, the use of laser perforated paper provides a cleaner printed sheet when printed on sheet-fed printing presses, electrographic and electrophotographic copiers, copier/duplicators, and printers. Laser perforated papers feed more uniformly into printing presses, photocopiers, copier/duplicators, and printers by reducing misfeeds and multi-sheet feeds.

The use of electrophotography, also known as xerography, to prepare plain paper copies of an original is well known and involves the use of a light-sensitive material known as a photoconductor. A photoconductor is a material that is an insulator in the dark and which has the property of being able to transport electric charge when exposed to light.

In the process of the present invention, a latent image can be generated on the surface of a suitable imaging element utilizing either an electrographic or an electrophotographic process. An "electrographic process" is one which involves the production of images by addressing an imaging surface, normally a dielectric material, with static electric charges (e.g., as from a stylus) to form a latent image which is then developed with a suitable toner. The term is distinguished from an "electrophotographic process" in which an electrostatic charge latent image is created by addressing a photoconductive surface with light. The photoconductor may be either organic or inorganic.

The latent image generated on the surface of the imaging element is developed with toner in any conventional manner, such as by electrophoretic or electrostatic disposition of the toner on the surface of the imaging element.

The developed image may then be transferred from the surface of the imaging element to the surface of the paper by any conventional method used in either electrography or electrophotography such as by utilizing heat and/or pressure or the application of an electric field.

In the present invention any conventional solid or liquid toner can be used, although solid toners are preferred. Both types of toners are well known in the art and hence, do not require a great deal of elaboration herein. Solid toners typically contain a pigment or colorant, such as carbon black, either dispersed in or coated with a thermoplastic material. Liquid toners typically are in form of organosols comprising a pigment dispersed in a non-conductive, hydrocarbon medium.

In order for paper to function properly in a photocopier, a balance must be struck between the various properties that affect print quality and paper handling within the machine. These balances were discussed by Green in a paper on "Functional Paper Properties in Xerography" (see C. J. Green, *Tappi,* 1981, 64(5), 79–81). He noted that print quality and paper handling are related to the smoothness, electrical resistivity, curl (sheet flatness), stiffness, moisture content, porosity, friction, finish, and wax pick of the paper and that very often the requirements for print quality conflict with those for paper handling. For example, smooth papers give better fix (toner adhesion), but rough papers give better feed properties and paper transport.

M. Scharfe in *Electrophotography Principles and Optimization;* Research Studies Press, Ltd.: Letchworth, England, 1984; pp. 5–9 describes seven basic steps in the xerographic process. These steps include: charging the photoconductor, exposing it to light to produce an electrostatic latent image, developing the image, transferring the image to paper, fusing the toned image to paper, cleaning the photoconductor, and erasing the image.

In some high-speed copier/duplicators this cycle takes place very rapidly and 90–135 copies/minute can be produced. This requires the copier/duplicator be in good adjustment and close tolerances be maintained and paper transport must be trouble free.

When perforated paper is printed in an electrophotographic photocopier, copier/duplicator, or printer, paper damage may occur at several places where pressure, tension, or stress on the paper is used to facilitate movement of the sheet through the machine.

The first place where paper damage to perforated paper may take place is the feed assembly station where paper is fed into the copier from the paper tray. Here, feed rollers introduce the top sheet from the stack of perforated paper into the machine's paper path. The feeding of paper into printing presses or electrophotographic copiers depends upon individual sheets being fed from a stack of the paper, and the mode of transfer of the sheet into the printing press or photocopier varies with the machine. Printing presses and electrophotographic copiers are designed to feed paper into the machine by several mechanisms. The paper may be fed by a vacuum pickup and transfer system, by a roller or belt which exerts pressure on the top sheet in the stack, by a roller or belt which exerts pressure on the top sheet in the stack in combination with a retard roller or belt beneath the stack, or by other suitable means. The success in feeding single sheets depends upon cleanly separating each sheet from the sheet underneath without dragging the second sheet or multiple sheets into the printer. In the case of mechanically perforated papers, abrasion and resultant stresses occur due to friction feeding between, for example, feed and retard belts and then as the paper is nipped between steel and polymeric rollers. A common mode of contamination at this location is from the buildup of paper detritus on the feed assembly rollers which later can flake off and transfer into the copying machine itself. Such flakes manifest themselves as large, irregularly shaped spots on the printed paper which usually appear after about 20,000 copies have been run on the machine.

In one common mechanism, a roller or belt pressed against the top sheet of the paper stack is employed as the feed means. These feed means move into engagement with the top sheet of the stack, exert pressure on the top sheet, usually by buckling the sheet, and releases and separates the sheet from the stack. The sheet can then be fed through "take away rolls" into the copier. The feed means usually remain at a fixed position in relation to the stack during sheet feeding.

In another feed system, a forward moving belt removes the top sheet from a stack of paper and advances the sheet to a set of pinch mils which then feed the sheet into the imaging and toner transfer stations. To prevent double feeds, a retard roller under the feed belt catches any second sheet that begins to transfer with the top sheet.

When mechanically perforated papers are employed in feed mechanisms containing rollers, belts, or retard mechanisms, the papers can separate along the line of perforation due to the pressure, buckling, pinching, grabbing, friction or other stresses induced by the feed mechanisms.

A second location for premature tearing along the line of perforation is at the toner transfer station where the paper travels between the photoreceptor and a bias transfer roll where it is again subjected to shear and pressure forces. It is very important to have the copying machine in proper adjustment at this location to minimize such forces which are obviously detrimental to perforation integrity.

A third location where pressure and stresses are put on the paper during the photocopying process is at the heat/pressure toner fusing station. Here, the surface temperature of the heat roller is about 204° C. (400° F.) and the pressure is thought to be about 140 psi. Pressure at these points can again cause paper tears and separation along the line of perforation.

When mechanically perforated paper is printed on an offset press, paper damage or tearing along the line of perforation may occur at several places in the press where pressure on the paper is used to facilitate movement of the sheet during printing. For example, in a table feed offset press, drive rollers buckle a sheet paper and feed it to a grip mechanism. Pressure exerted by the drive rollers can tear sheets along the line of perforation. The grip mechanism grabs the edge of the paper and feeds it into the printing mechanism. The pressure exerted by the grip mechanism can also tear paper along the line of perforation. In the printing region, the paper is fed between a blanket cylinder and an opposing impression cylinder. In this region, where machine adjustment is critical to insure efficient and uniform ink transfer to the paper under controlled pressure, additional paper damage can occur.

The use of laser perforated papers promotes uniform feeding of perforated sheets into sheet-fed printing presses, photocopiers, photocopier/duplicators, and printers by reducing misfeeds and multi-sheet feeds.

Although not wishing to be bound by theory, it is believed that laser perforation removes fibers from the sheets forming a paper with less resistance to fold than unperforated paper, while maintaining much greater tear resistance than mechanically perforated paper. Because some of the paper has been removed by laser perforation, them is less resistance to folding multiply collated sheets at one time, and a natural tendency for the sheet to fold on the line of perforation. The paper remaining in the land areas, acts as a hinge and provides strength as well as the ability to lie flat. This results in a signature having the advantageous properties of a mechanically or water-scored signature; e.g., flat profile, low "bow," and tight fold.

It is also an advantage of the perforations to allow the binding of signatures using gluing techniques. The glue can penetrate through the sheets along the perforation and, upon drying, form a bound signature.

In addition to being useful in the preparation of signatures, the use of laser-perforated paper to prepare brochures and pamphlets with other folding arrangements is envisioned. For example, an 8½ inch by 11 inch sheet is often printed upon and folded in thirds to form a 6-page brochure, with 3 panels of 3⅔ inches by 8½ inches. Such a fold is called a gatefold. The use of laser-perforated papers to prepare gatefold brochures and pamphlets provides the same improved compression, lay-flat (i.e., significantly reduced bowing), storage and handling properties as compared to conventionally prepared gatefold brochures and pamphlets The present invention will be further described by reference to the following detailed examples. These examples are presented to illustrate the advantages and operation of the invention and are not to be construed as limiting its scope.

EXAMPLES

EXAMPLE 1

Samples of perforated 17 inch×11 inch 20 pound bond paper were produced by laser-perforating a bond paper web and cutting into 17 inch by 11 inch sheets on a commercial sheeter available from the E. C. Will Company. The perforation was to aid in folding. The sheets were printed upon using a Xerox Model 5090 copier/duplicator. The paper fed well and without jamming in the machine or separation along the line of perforation.

Four sheets of perforated 17"×11" paper were collated, folded, and stapled on the perforation using a Harris Multigraphics Multibinder Model 250 to give a 16-page laser-perforated signature. Folding of the 16-page laser-perforated signatures resulted in excellent folds. The signatures were very flat and without bowing at the spine. There was no tearing or separation along the perforation. The perforation allowed stress relief to the folding resulting in much flatter fold signatures.

In a similar manner, 15 sheets of perforated 17"×11" paper were collated, folded, and stapled on the perforation to make a 60-page laser-perforated signature. Folding of the 60-page laser-perforated signatures resulted in excellent folds. Again, the signatures were very flat, without bowing at the spine. There was no tearing or separation along the perforation. The perforation allowed stress relief to the folding resulting in much flatter fold signatures.

The thickness of the signatures was measured in the following manner. The samples were suspended by a clamp attached to the open end of each signature. The folded, bound spine edge hung downward. A micrometer was used to measure the thickness of the signatures. Measurements were made at the each end and in the middle of each signature 1 inch from the folded edge (i.e., the spine). The results, shown below, indicate that signatures prepared using laser-perforated paper are flatter than signatures similarly prepared using non perforated bond paper.

| | Thickness of Perforated Signatures | | | |
|---|---|---|---|---|
| | 16-Page Signature | | 60 Page Signature | |
| | Non-Perforated | Perforated | Non-Perforated | Perforated |
| | 0.544 inches | 0.387 inches | 0.871 inches | 0.651 inches |
| | 0.613 inches | 0.344 inches | 0.891 inches | 0.633 inches |
| | 0.628 inches | 0.282 inches | 0.825 inches | 0.600 inches |
| Average | 0.595 inches | 0.338 inches | 0.862 inches | 0.628 inches |

EXAMPLE 2

The 16-page signatures prepared in Example 1 above were stacked and the height of the stack measured. The heights of the stacks were compared with the height of signatures prepared in a similar manner, using the same basis weight paper but without laser perforation on the fold.

As shown below, the height of a stack of laser-perforated signatures is less than the height of a similar stack of signatures prepared from non-perforated paper. The stack of laser-perforated signatures was also noticeably less bowed than a similar stack prepared from folded non-perforated paper.

| Number of | Stack Thickness | |
|---|---|---|
| Signatures | Laser-Perforated | Non-Perforated |
| 5 | 0.44 inches | 1.25 inches |
| 10 | 0.69 inches | 1.88 inches |
| 15 | 1.00 inches | 2.44 inches |
| 20 | 1.25 inches | 2.98 inches |
| 25 | 1.50 inches | 3.38 inches |
| 30 | 1.75 inches | 3.81 inches |

EXAMPLE 3

Samples of perforated 17 inch×11 inch 20 pound basis weight bond paper were produced by laser-perforating a bond paper web and cutting into 17 inch by 11 inch sheets on a commercial sheeter available from the E. C. Will Company.

The sheets were printed upon using a Xerox Model 5090 copier/duplicator. The paper fed well and without jamming in the machine or separating along the line of perforation. Varying numbers of sheets were collated, folded, and stapled on a Harris Multigraphics Multibinder Model 250 to give a signatures. The signatures were opened to the center of the signature and laid face-down on a flat surface. The signatures displayed a noticeable "peak," with the fold higher than the edge of the signature. The height of the peak of the fold above the flat surface was measured and compared with the height of signatures prepared in a similar manner, using the same basis weight paper but without laser perforation on the fold.

As shown below, the height of the peak of an open, face-down stack of laser-perforated signatures is noticeably less than the height of a stack of signatures similarly prepared using non-perforated paper.

| Number of | Average Peak Height | |
|---|---|---|
| Sheets/Leafs/Pages | Laser-Perforated | Non-Perforated |
| 3/6/12 | 0.38 inches | 2.10 inches |
| 6/12/24 | 0.22 inches | 1.56 inches |
| 9/18/36 | 0.31 inches | 1.25 inches |
| 12/24/48 | 0.34 inches | 1.38 inches |
| 15/30/60 | 0.25 inches | 1.44 inches |

Reasonable variations and modifications are possible from the foregoing disclosure without departing from either the spirit or scope of the present invention as defined by the claims.

What is claimed is:

1. A process for producing a folded, bound, laser-perforated, paper-based construction, said process comprising the steps of:

(a) creating a line of perforations through a paper substrate by exposure to a laser beam;

(b) collating a plurality of the laser perforated paper substrates prepared in step (a) into sets;

(c) folding said sets on their lines of perforation; and (d) binding said folded sets on their lines of perforation into a signature.

2. The process according to claim 1 wherein said plurality of perforations has a hole/land ratio of about 1:10 to 6:1 and a minimum of one hole per inch.

3. The process according to claim 1 wherein said line of perforation on said paper substrate is positioned lengthwise along a sheet of paper.

4. The process according to claim 1 wherein in step (d) said binding of said folded sets on their lines of perforation into a signature is accomplished with a staple, a stitch, or an adhesive.

5. A folded, bound, laser-perforated, paper-based construction prepared by the process of:

(a) creating a line of perforations through a paper substrate by exposure to a laser beam;

(b) collating a plurality of the laser perforated paper substrates prepared in step (a) into sets;

(c) folding said sets on their lines of perforation; and (d) binding said folded sets on their lines of perforation into a signature.

6. A folded, bound, laser-perforated, paper-based construction prepared by the process of claim 5 wherein said line of perforation on said paper substrate is positioned lengthwise along a sheet of paper.

7. A folded, bound, laser-perforated, paper-based construction prepared by the process of claim 5 wherein in step (d) said binding of said folded sets on their lines of perforation into a signature is accomplished with a staple, a stitch, or an adhesive.

8. A process for producing a folded, bound, laser-perforated, paper-based construction said process comprising the process of:

(a) creating a line of perforations through a paper substrate by exposure to a laser beam;

(b) collating a plurality of the laser perforated paper substrates prepared in step (a) into sets;

(c) binding said sets on their lines of perforation; and (d) folding said sets on their lines of perforation into a signature.

9. The process according to claim 8 wherein said plurality of perforations has a hole/land ratio of about 1:10 to 6:1 and a minimum of 1 hole per inch.

10. The process according to claim 8 wherein said line of perforation on said paper substrate is positioned lengthwise along a sheet of paper.

11. The process according to claim 8 wherein the binding is a staple, a stitch, or an adhesive.

12. A folded, bound, laser-perforated, paper-based construction prepared by the process of:

(a) creating a line of perforations through a paper substrate by exposure to a laser beam;

(b) collating a plurality of the laser perforated paper substrates prepared in step (a) into sets;

(c) binding said sets on their lines of perforation; and (d) folding said sets on their lines of perforation into a signature.

13. A folded, bound, laser-perforated, paper-based construction prepared by the process of claim 12 wherein said line of perforation on said paper substrate is positioned lengthwise along a sheet of paper.

14. A folded, bound, laser-perforated, paper-based construction prepared by the process of claim 12 wherein in step (c) said binding of said folded sets on their lines of perforation into a signature is accomplished with a staple, a stitch, or an adhesive.

15. A process for producing a folded, bound, laser-perforated, paper-based construction said process comprising the steps of:

(a) creating a line of perforations through a paper substrate by exposure to a laser beam;

(b) generating a latent image on a surface of an imaging element;

(c) developing said latent image with toner;

(d) transferring said developed image to the surface of said laser perforated paper substrate, (e) collating a plurality of the laser perforated paper substrates prepared in step (d) into sets;

(f) folding said sets on their lines of perforation; and (g) binding said folded sets on their lines of perforation into a signature.

16. The process according to claim 15 wherein said imaging element is a dielectric material.

17. The process according to claim 15 wherein said imaging element is a photoconductor.

18. The process according to claim 15 wherein said toner is in the form of a powder.

19. The process according to claim 15 wherein said toner is liquid.

20. The process according to claim 15 wherein said transfer step in (d) is conducted with heat and pressure.

21. The process according to claim 15 wherein said transfer step in (d) is conducted in the presence of an electric field.

22. A folded, bound, laser-perforated, paper-based construction prepared by the process of:

(a) creating a line of perforations through a paper substrate by exposure to a laser beam;

(b) generating a latent image on a surface of an imaging element;

(c) developing said latent image with toner;

(d) transferring said developed image to the surface of said laser perforated paper;

(e) collating a plurality of the laser perforated paper substrates prepared in step (d) into sets;

(f) folding said sets on their lines of perforation; and (g) binding said folded sets on their lines of perforation into a signature.

23. A folded, bound, laser-perforated, paper-based construction prepared by the process of claim 22 wherein said imaging element is a photoconductor.

* * * * *